US005931258A

United States Patent [19]

Lorentz

[11] Patent Number: 5,931,258

[45] Date of Patent: Aug. 3, 1999

[54] EXTENDIBLE SAFETY POSTS FOR MANHOLE LADDERS

[76] Inventor: Garry Lorentz, 307 Pinegrove Close N.E., Calgary, Alberta, Canada, T1Y 1L3

[21] Appl. No.: 09/013,984

[22] Filed: Jan. 27, 1998

[51] Int. Cl.[6] ..... E06C 7/18

[52] U.S. Cl. ..... 182/93; 182/97; 182/106

[58] Field of Search ..... 187/106, 93, 97

[56] References Cited

U.S. PATENT DOCUMENTS

| | | | |
|---|---|---|---|
| 1,916,208 | 7/1933 | Diou . | |
| 3,136,384 | 6/1964 | Sweeney | 182/106 |
| 3,455,414 | 7/1969 | Higgins | 182/106 |
| 3,598,200 | 8/1971 | Thompson | 182/8 |
| 3,908,791 | 9/1975 | Kleine et al. | 182/8 |
| 4,111,280 | 9/1978 | Devine et al. | 182/8 |
| 4,193,475 | 3/1980 | Sweet et al. | 182/8 |
| 4,252,214 | 2/1981 | Miller | 182/8 |
| 4,269,284 | 5/1981 | Swager | 182/8 |
| 4,546,855 | 10/1985 | Lyons | 182/106 |
| 5,282,339 | 2/1994 | Devlin | 182/106 |

*Primary Examiner*—Alvin Chin-Shue
*Attorney, Agent, or Firm*—Thomas E. Malyszko

[57] ABSTRACT

A retractable safety post for facilitating access in and out of a manhole is slidably attached to each side rail of a wall-mounted ladder. Each post slides within a tubular sleeve fixed to the side rail and is selectively movable between a retracted or stowed position to an extended or use position. Each post has at its upper end a cap and handle for ease of grasping during use, and at its lower end a latch member for securing the post in its extended position during use. A wall bracket anchoring the ladder to the manhole serves as a resting support for the latch member and its post when in the extended position. The post is secured in the extended position by merely lifting the post, twisting the post a given amount in a pre-set direction, and lowering the post slightly so that the latch member can engage the wall bracket. In its stowed position, the post rests wholly within the manhole.

10 Claims, 5 Drawing Sheets

EXTENDIBLE SAFETY POSTS FOR MANHOLE LADDERS

FIELD OF THE INVENTION

The present invention relates to safety extensions for ladders generally, and in particular relates to extendible safety posts for wall-mounted manhole ladders to facilitate access in and out of manholes.

BACKGROUND OF THE INVENTION

Manhole ladders which are permanently fixed to the inside wall of a manhole are typically wholly located within the manhole below its upper rim so that the manhole entrance can be covered with a manhole plate or grate. The fact that the ladder does not extend above the manhole entrance makes it difficult to mount and dismount the top end of the ladder. Therefore, manhole users must support and balance themselves from the rim of the manhole during entry until their bodies are almost entirely within the manhole and their hand can grasp the top rung of the manhole ladder, and likewise upon exiting the manhole. Such entry and exit is dangerous since users can slip and fall during these maneuvers, causing injury. The danger and inconvenience is augmented when users must carry tools, building materials or the like into and out of the manhole.

Some prior art devices have been proposed to address this problem, although with limited success. In particular, U.S. Pat. Nos. 3,598,200 (Thompson) and 4,546,855 (Lyons) both disclose a single rod device extendible from inside a manhole where it is slidably attached to the middle of the upper rungs of a manhole ladder. Thompson has a support at the lower end of the rod to releasably engage a ladder rung to retain the rod in an extended position. The support may be accidentally dislodged during use by a relatively small upward movement of the rod, causing the rod to collapse. The Lyons rod has an involved arrangement of brackets, plates and pins which must be hand-activated by a lever mechanism to retain the rod in an extended position. The arrangement is cumbersome since it requires a two-handed operation to raise and lower the rod. The number of parts in the Lyons system makes it needlessly complex and expensive to produce. In any event, the rods of both patents obstruct the middle of each manhole ladder and consume what little space one has on the rungs of the ladder for foot and hand placement. The location of the rods also requires a user to swing about the post in order to mount and dismount the ladder, which is a potentially dangerous maneuver over an open manhole. There is also the inconvenience of not being able to carry tools or the like since both hands must grasp the post during such maneuvering.

What is therefore desired is a novel device to facilitate safe entry and exit of a manhole on a manhole ladder and which overcomes the limitations and disadvantages of the prior art devices. Preferably, the device should provide two retractable safety posts that do not interfere with foot space on any ladder rungs, that are located on the sides of the ladder to allow direct access to the ladder rungs while providing a user with hand support, and that provide a user with the option of support with one or both hands, particularly when carrying tools or the like. The posts should be capable of quick and convenient extension and retraction with a simple means of positively locking the posts when extended. The device should further be inexpensive to manufacture and install, and be reliable and safe to use.

SUMMARY OF THE PRESENT INVENTION

According to one aspect of the present invention, there is provided a safety system or a manhole ladder having a plurality of elongate rungs supported between upright side rails, said side rails being secured to an inside surface of a manhole using a plurality of wall rackets, the system comprising:

an elongate post member slidably engaged to each of said side rails and movable between an inoperative position for location within said manhole when not in use, and an operative position for extension above said manhole ladder to support a user mounting or dismounting said manhole ladder.

According to another aspect of the invention there is provided an extendible safety arrangement for a ladder fixed inside a manhole by a plurality of anchor elements, said arrangement comprising an elongate post slidably engaged to each side of said ladder, said post being movable between a retracted position in which said post is wholly located within said manhole, and an extended position in which said post extends out of said manhole to support a user mounting or dismounting said ladder by lifting said post from said retracted position and twisting the post to lock said post in said extended position.

According to yet another aspect of the invention there is provided a retractable safety device for a manhole ladder with dual railings supported on wall anchors, the device comprising:

sleeve means connectable to said manhole ladder;

two elongate post members slidably mounted within said sleeve means;

locking support means mounted at the lower end of said post members for supporting said post members in an extended position for use by a manhole operator; and handle means mounted at an upper end of said post members for hand gripping during use and for supporting said post members while in a retracted position.

BRIEF DESCRIPTION OF THE DRAWING FIGURES

Embodiments of the invention will now be described, by way of example only, with reference to the accompanying drawings, wherein.

Figure 2:
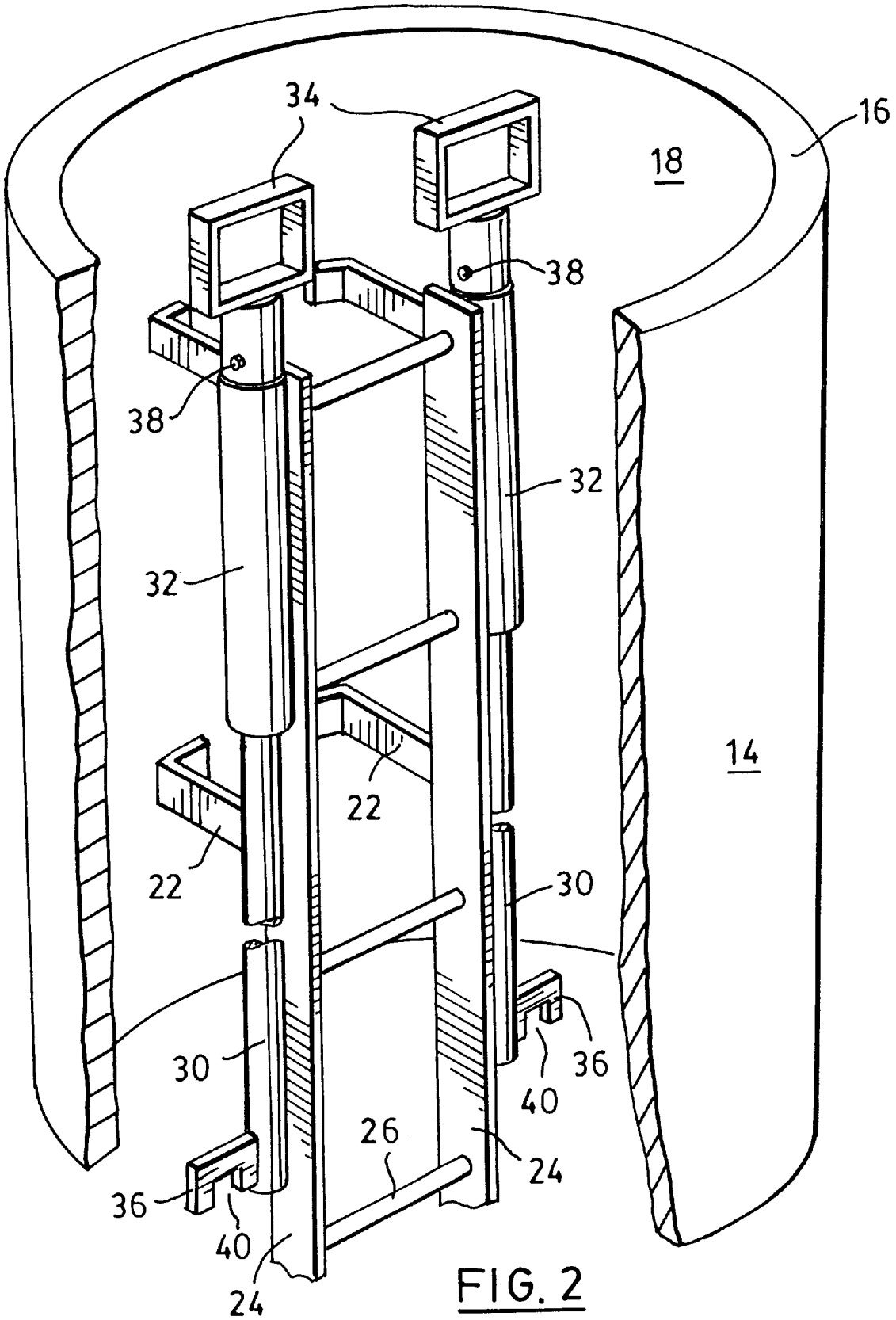
FIG. 2 is a close-up view of a portion of the manhole of FIG. I showing the retracted safety posts of the first embodiment.
Figure 2A:
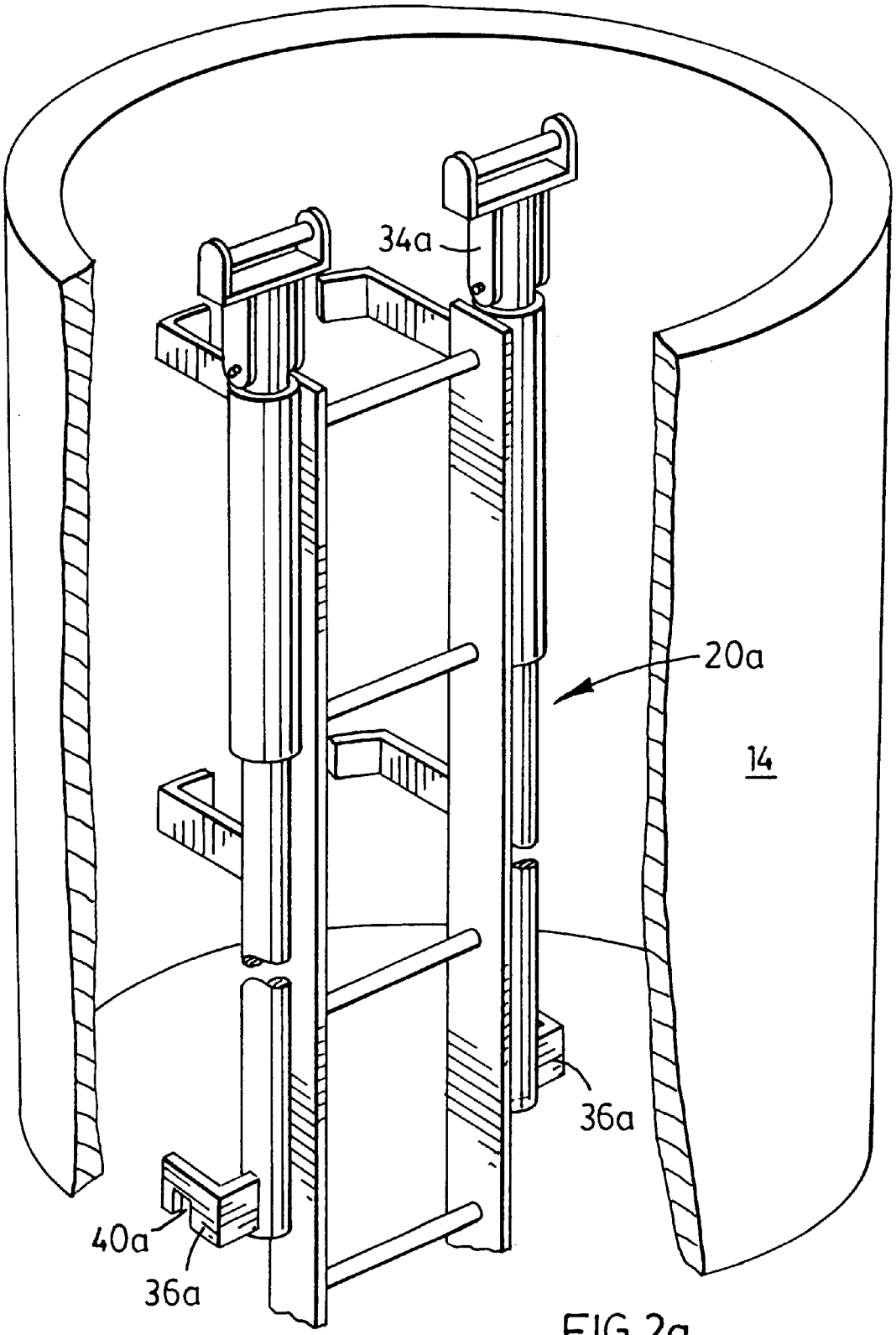
Figure 3:
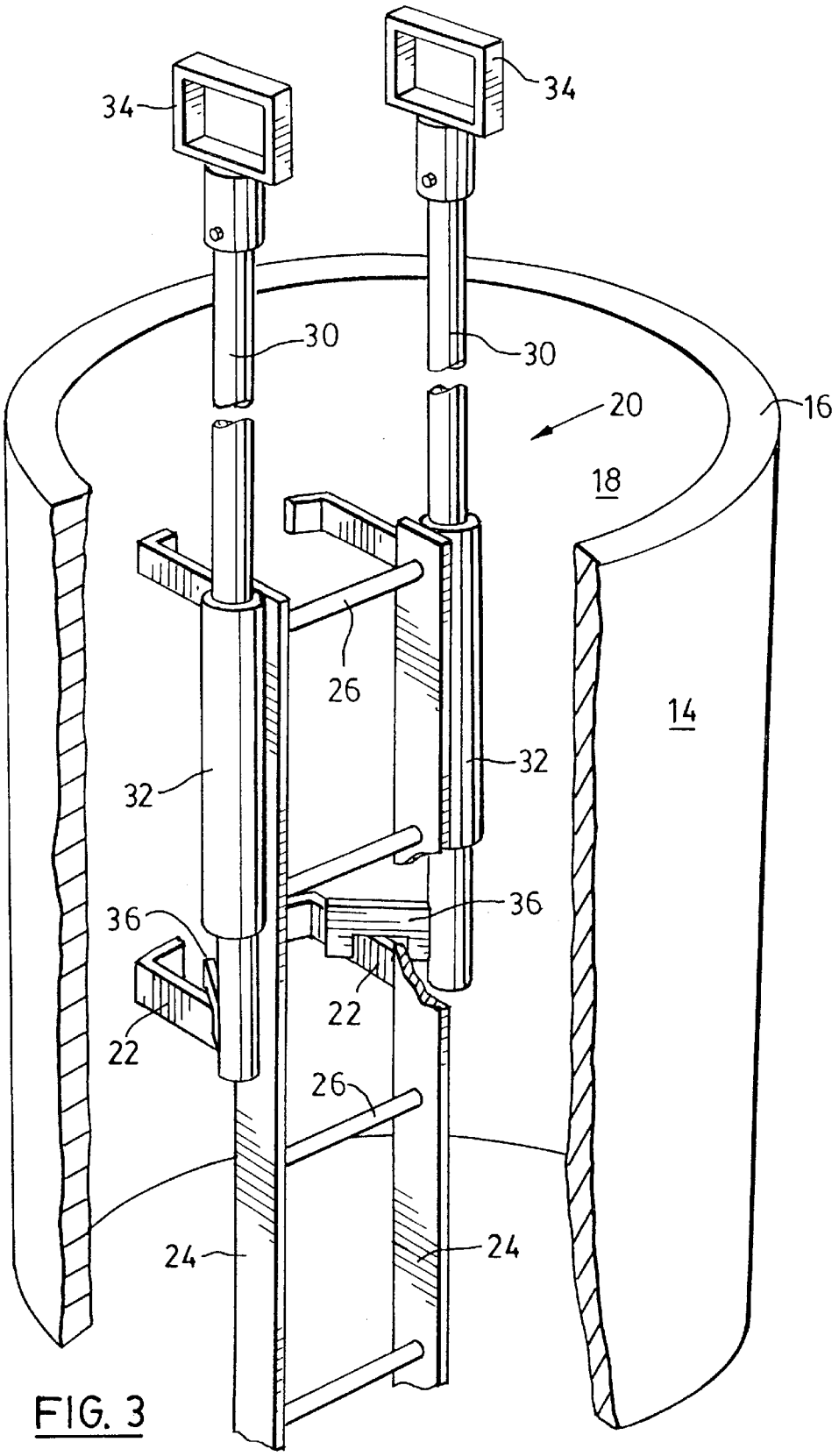
Figure 3A:
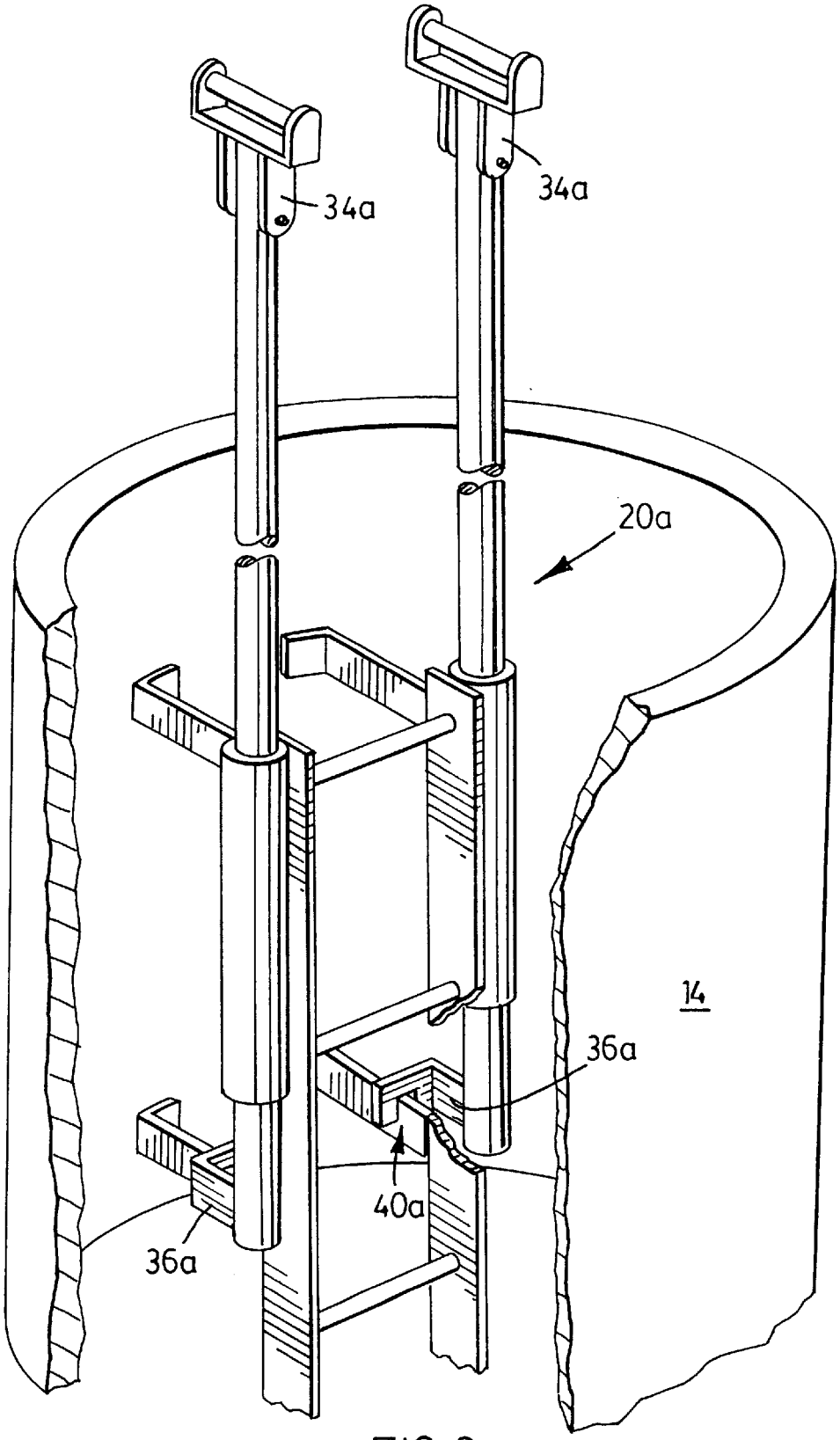

FIG. 2*a* is a view similar to FIG. 2 showing retracted safety posts according to a second embodiment of the invention;

FIG. 3 shows the safety posts of FIG. 2 in an extended or raised position; and, FIG. 3*a* shows the safety posts of FIG. 2*a* in an extended or raised position.

DESCRIPTION OF PREFERRED EMBODIMENTS

Figure 1:
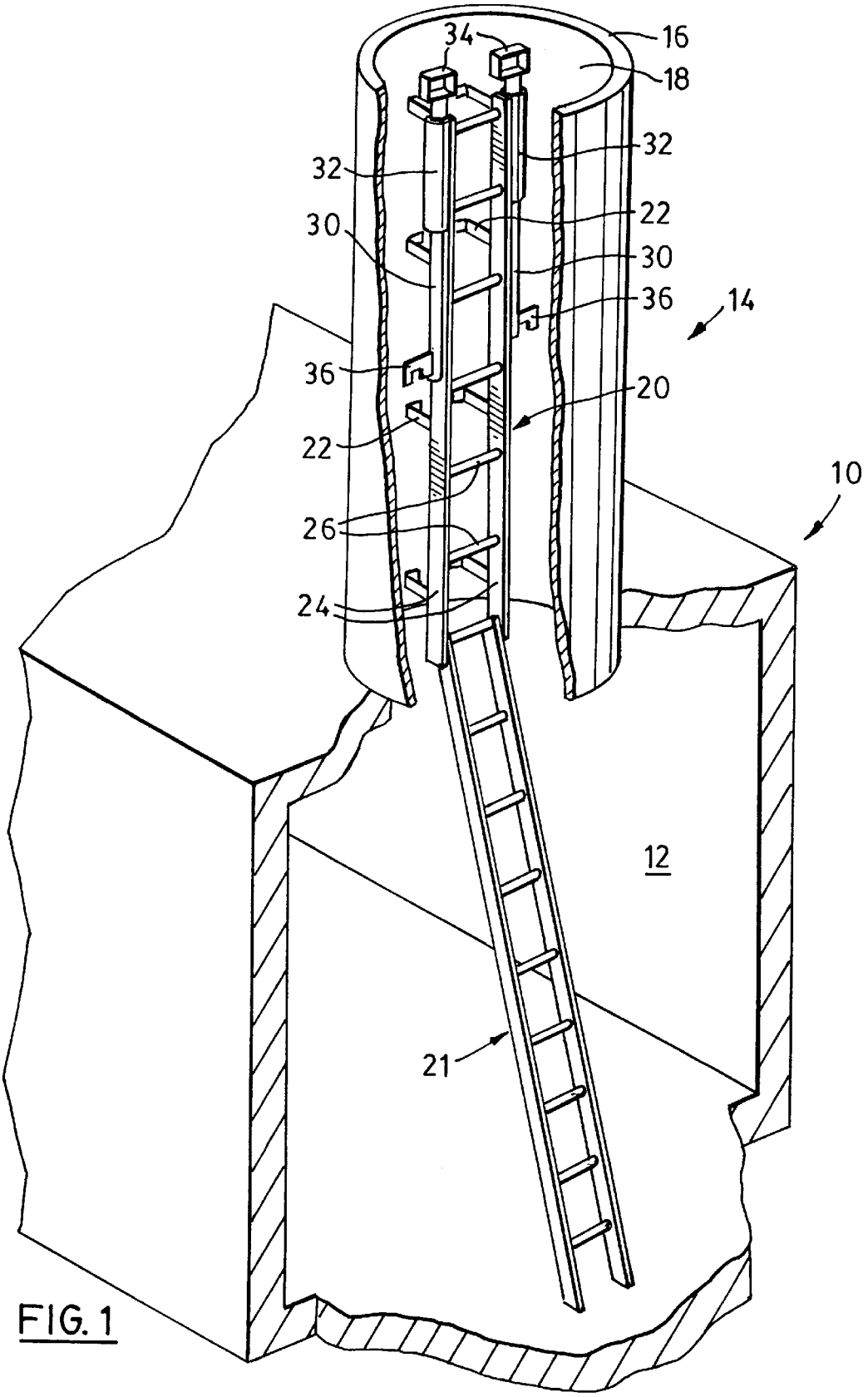
FIG. 1 is a perspective view, partially broken away, of a typical underground installation with a manhole access shaft to an underground vault, and a manhole ladder with retractable safety posts according to a first preferred embodiment of the present invention in their retracted or stowed position.

Reference is first made to FIG. 1 which shows a typical underground installation, generally indicated by reference numeral 10, having a manhole shaft 14 for accessing an underground conduit or vault 12 that might be used in a municipal sewage system, storm water drainage system, electrical conduit network, or the like. A manhole ladder 20 is located below the rim or lip 16 of the manhole and is permanently attached or fixed to an inside manhole surface or wall 18 by a series of anchor elements or wall brackets 22 which engage the upright support members or side rails 24 of the ladder. The wall brackets and are normally welded on, screwed on or bolted onto the rails 24 and the manhole wall 18. The ladder rungs between the rails 24 are indicated by 26 The manhole shown in FIG. 1 is generally cylindrical and vertically oriented, although it will be appreciated that it can come in various shapes and orientations, as dictated by local conditions and requirements. A manhole cover, such as a grate or solid iron plate (not shown), is typically placed over the rim 16 to close the manhole when it is not in use. The bottom of the manhole ladder 20 has a vault ladder 21 attached thereto for access into the vault 12. Unlike the manhole ladder which is oriented generally vertically within the manhole 14, the vault ladder 24 may be gently inclined (typically 10 degrees or more from vertical) for ease of use since it is not subject to the same space restrictions as the manhole ladder.

Referring now to FIG. 2 also, a top portion of the manhole ladder is shown in greater detail, as is the retractable safety post system of the present invention. The system generally includes an elongate post 30 which is slidably engaged with each side rail 24 via a tubular sleeve 32. Each sleeve 32 is fixed to an outer face of the side rail 24, as by welding or equivalent means, to avoid interference with the ladder rungs 26. Each post 30 has a handle 34 adapted to be grasped by a user for lifting, twisting and otherwise manipulating the post, and a latch or support arm 36 at its bottom end. Each handle 34 has a hollow tubular lower portion which fits over the top end of the post and is fastened thereto using a fastener 38 such as a bolt or locking pin which may be inserted into predrilled aligned holes in both the handle and post. The fastener 38 is preferably removable so that the handle can be lifted off the post and the post can be removed from the sleeve, if desired. In the embodiment shown in FIG. 2, the lower tubular portion of the handle is made of tubing having a larger outer diameter than the inside diameter of the corresponding sleeve 32 so that the handle's tubular portion acts as a stop when the post 30 is lowered to its retracted position, as shown. Alternately, the upper grasping portion of the handle may be relied upon to act as a stopper.

The support arm 36 is fixed adjacent the bottom of the post by welding or equivalent means. In the preferred embodiment the support arm 36 is in the form of a generally flat metal plate extending radially away from the post a sufficient distance so that the plate can properly engage a wall bracket upon twisting the post to place the post in an extended position, as shown in FIG. 3. The bottom edge of the support arm plate has a notch 40 for engaging the wall bracket 30 to secure the post in the extended position, as discussed below.

The operation and use of the present invention may now be better appreciated with reference to FIGS. 2 and 3. FIG. 2 shows the posts 30 as they would be found upon lifting a manhole cover for entry into the manhole, namely the posts 30 are in a fully retracted position with the handles 34 located below the manhole rim 16 so as not to interfere with the manhole cover. Each handle 34 is then grasped by the user, preferably one at a time, and the post 30 is lifted until the support arm 36 engages the bottom of the sleeve 32, thus preventing any further upward movement. Each post is next twisted toward the wall brackets (i.e. either clockwise for the left hand post as viewed in FIG. 3 or counterclockwise for the right hand post) and then lowered slightly to allow the notch 40 to engage the top of the wall bracket 22. The posts are now in their fully extended or operative positions as shown in FIG. 3, ready to support a user wishing to mount the ladder. The notch 40 keeps each post in the extended position by preventing the support arm 36 from inadvertently disengaging the wall bracket during use, and thus avoiding collapse of the post.

The user will typically enter the manhole by stepping backwards off the manhole rim between both of the extended posts and onto the first ladder rung, using the post handles for balance and support. As the user descends into the manhole, the tubular posts may be grasped for further support until such time as the user is low enough in the manhole to comfortably grasp the side rails 24 of the manhole ladder. Hence, in the preferred embodiment, each post and sleeve is tubular in shape to be comfortably grasped by the user and lacks sharp edges or protrusions to avoid hand injury. Each post should also be of a length so that in the extended position the post handles 34 are located at a height above the lip to allow the user to comfortably grasp the handles for support and balance upon entering and exiting the manhole.

The reverse procedure is followed to bring the posts from the extended position (FIG. 3) back to the retracted position (FIG. 2). Each post is unlocked by lifting the handle 34 to disengage the support arm 36 from the wall bracket 22, and twisting the post to swing the support arm away from the wall bracket. Once the support arm is clear of the wall bracket, the post is lowered into the manhole until handle 34 rests atop the sleeve 32.

It will now be appreciated that the sleeve's length and location on the ladder's side rail should be such that: (a) the post handles 34 are located below the manhole lip in their retracted position; and (b) the post support arm is located just above the wall bracket prior to the notch 40 engaging the wall bracket when lifting and twisting the post into the extended position. It is also desired, although not necessarily required, that in the extended position the handles 34 should be positioned in a natural and comfortable hand grasping orientation, namely generally perpendicular to the ladder rungs as shown in FIG. 3. Since not all manhole ladder dimensions and shapes are uniform, an efficient manner of achieving such handle position when installing the posts is to engage the support arm on the wall bracket, and then install and fasten the handle in the desired orientation atop the post.

In the preferred embodiment of FIGS. 1–3, good results have been achieved using 1.5 inch (aprox. 3.8 cm) diameter pipe between 6 to 7 feet in length for the posts 30 to allow them to extend about 4 feet above ground level or the manhole lip. For sleeves 38, a hollow pipe with an inner diameter slightly larger than the post's outer diameter is used to allow the post to slide therein without excessive lateral play. A sleeve length of about 8 inches (aprox. 20.3 cm) has been used successfully.

Referring to FIGS. 2*a* and 3*a*, an alternate embodiment of the invention is shown where the support arms 36*a* are formed of an angled plate so that the notches 40*a* engage the wall brackets in a generally perpendicular manner rather than at an angle as in the FIG. 1–3 embodiment. The handles 34*a* also have a bottom portion made of two spaced plates rather than a hollow tube for engaging the top of the posts. This alternate embodiment is not preferred due to slightly higher manufacturing and installation costs.

Some of the many other advantages of the safety posts of the present invention may also be appreciated. The user need not twist or perform other dangerous maneuvers over the manhole upon entry or exit since the posts extend from either side of the ladder. Hence, the user has unobstructed access to the top ladder rungs while using the posts for support and balance. If desired, the user has the option of extending and using only one of the posts, although this is not preferred. One can hang warning signs or other notices across post members in the extended position.

The above description is intended in an illustrative rather than a restrictive sense, and variations to the specific configurations described may be apparent to skilled persons in adapting the present invention to other specific applications. Such variations are intended to form part of the present invention insofar as they are within the spirit and scope of the claims below. For example, the sleeve need not be a single continuous piece of tubing but may comprise two or more pieces or rings either spaced apart or joined together. In manhole ladders without continuous side rails but with rungs which extend directly from the inside surface of the manhole, the sleeve may be fixed to the transverse portions of such rungs.

I claim:

1. In a manhole ladder having a plurality of elongate rungs supported between upright side rails, said side rails being secured to a plurality of wall brackets fixed to an inside surface of a manhole, the improvement comprising an elongate post member slidably engaged to each of said side rails and movable between an inoperative position for location within said manhole when not in use, and an operative position for extension above said manhole ladder to support a user mounting or dismounting said manhole ladder, the post member including a support arm so that said post member is maneuverable between an unlocked position wherein said post member is free to slide between said operative and inoperative positions, and a locked position wherein said support arm engages one of said wall brackets to slidably lock the post member in said operative position, said post member being adapted to twist about its longitudinal axis and being operable between said locked and unlocked positions by a single lifting and twisting motion of said post member to bring said support arm into and out of engagement with one of said wall brackets, respectively.

2. The manhole ladder of claim 1 wherein said support arm comprises a plate member having a notch for mating the support arm with one of said wall brackets to avoid disengagement thereof during use of the post member.

3. The manhole ladder of claim 2 wherein said support arm is located at a bottom end of said post member, and a handle for grasping by a user is mounted at a top end of said post member.

4. The manhole ladder of claim 3 wherein an open ended sleeve attached to each of said upright side rails slidably receives said post member, and wherein in said inoperative position said handle engages said sleeve to support the post member thereon and to prevent further sliding therethrough.

5. A combination of an extendible safety arrangement and a ladder fixed inside a manhole by a plurality of anchor elements comprising an elongate post slidably engaged to each side of said ladder, said post being movable between a retracted position in which said post is wholly located within said manhole, and an extended position in which said post extends out of said manhole to support a user mounting or dismounting said ladder by lifting said post from said retracted position and twisting the post to lock said post in said extended position, said post including a plate-like support arm at a lower end thereof engaging one of said anchor elements to lock said post in said extended position, and said support arm including a means for positively engaging said support arm on said anchor element.

6. The combination of claim 5, wherein said means for positively engaging comprises a notch along a bottom edge of said support arm for engaging said anchor element.

7. The combination of claim 6 wherein said post is slidably located within a hollow sleeve mounted to one of said sides of the ladder, and a top end of said sleeve supports said post when in said retracted position and a bottom end of said sleeve acts as a stop for limiting upward sliding of said post when being placed into said extended position.

8. A retractable safety device on a manhole ladder with dual railings supported on wall anchors on an inside surface of a manhole, the device comprising:

a) sleeve means connectable to said manhole ladder;

b) two elongate post members slidably mounted within said sleeve means;

c) locking support means mounted at the lower end of said post members for supporting said post members in an extended position for use by a manhole operator, said locking support means supporting said post members by resting on said wall anchors; and d) handle means mounted at an upper end of said post members for hand gripping during use and for supporting said post members while in a retracted position.

9. The support assembly of claim 8 wherein said locking support means has a notch means for engaging said wall anchors and for preventing inadvertent disengagement of said locking support means during use.

10. The support assembly of claim 9 wherein said handle means has an opening for ease of grasping by hand and is adapted to be removable from said post members for removing said post members from said sleeve means.

* * * * *